United States Patent [19]

Tokura

[11] Patent Number: 4,930,338

[45] Date of Patent: Jun. 5, 1990

[54] PIPE EXPANDING MANDREL

[75] Inventor: Kengi Tokura, Osaka, Japan

[73] Assignee: Kyoshin Kogyo Kaburshiki Kaisha, Osaka, Japan

[21] Appl. No.: 309,871

[22] Filed: Feb. 14, 1989

[51] Int. Cl.[5] ..... B21D 41/02

[52] U.S. Cl. ..... 72/479; 72/370; 29/727

[58] Field of Search ..... 72/370, 393, 479; 29/726, 727, 157 R

[56] References Cited

U.S. PATENT DOCUMENTS

| | | | |
|---|---|---|---|
| 1,235,835 | 8/1917 | Nilson | 29/727 |
| 3,568,303 | 3/1971 | Akio | 72/370 |
| 4,263,713 | 4/1981 | Smith et al. | 29/727 |
| 4,573,340 | 3/1986 | Kammeraad | 72/479 |
| 4,644,775 | 2/1987 | Fuchs, Jr. | 72/393 |
| 4,779,445 | 10/1988 | Rabe | 29/727 |

*Primary Examiner*—David Jones

*Attorney, Agent, or Firm*—Birch, Stewart, Kolasch & Birch

[57] ABSTRACT

A pipe expanding mandrel is disclosed which comprises a set pin having a pipe expanding billet mounted on a front end portion thereof and a stepped portion formed at a site behind the billet, a sleeve slidably fitted on a rear portion of the set pin, a spring interposed between the stepped portion of the set pin and the front end of the sleeve, and a mandrel body. An engagement protuberance formed on a rear end portion of the set pin is brought in engagement with an engagement hole bored in a front end portion of the mandrel body, and then the set pin is turned, so that the set pin and the sleeve are coupled to the mandrel body while being prevented from disengagement therefrom by the action of the spring. In conjunction with this coupling, engagement lugs formed at the rear end of the sleeve is brought in engagement with an engagement groove formed at the front end of the mandrel body, so that the set pin and sleeve are coupled to the mandrel body while being prevented from rotation by the action of the spring.

8 Claims, 3 Drawing Sheets

PIPE EXPANDING MANDREL

FIELD OF THE INVENTION

This invention relates to improvements in pipe expanding mandrels for use in pipe expanding operations in which the mandrel is used by being inserted under pressure into the pipe to be expanded.

BACKGROUND OF THE INVENTION

As is well known, a pipe expanding mandrel of this type requires change in the size of the pipe expanding billet at the front end of the mandrel according to a desired change in the diameter of the pipe to be expanded. However, replacing the entire mandrel each time when there is a change in desired pipe diameter involves removal of the mandrel from and mounting another mandrel to the pipe expanding apparatus. Such mounting and removing operations are very troublesome and time-consuming.

In order to facilitate billet replacing operations according to desired changes in the required billet size, there has hitherto been often used means such as that illustrated in FIG. 6, for example, wherein a pin 2*a* inserted through a pipe expanding billet 3 is brought in mating engagement with an internally threaded portion 30 formed in a front end portion of a mandrel shaft 13*a*, the billet 3 being firmly fixed in position by the pin 2*a*, whereby the billet 3 alone can be replaced through removal of the pin 2*a* without requiring the replacement of the entire pipe expanding mandrel.

With such conventional means, however, it is necessary that in replacing the pipe expanding billet 3, the pin 2*a* which is in threaded engagement with the mandrel shaft 13*a* be disengaged from the mandrel shaft 13*a* by rotation of the pin 2*a*. Thus, the prior art means still involves a drawback from the standpoint of ease of operation because the disengagement and engagement operations required with respect to the pin 2*a* are troublesome and time-consuming,. though the means provides some improvement over the earlier practice which required replacement of the entire mandrel.

SUMMARY OF THE INVENTION

This invention is directed to overcoming the aforesaid difficulty with the prior art, and therefore it is a primary object of the invention to provide a pipe expanding mandrel which requires no troublesome operation including pin removal and insertion as has hitherto been involved in connection with each replacement of a pipe expanding billet. The present invention enables the replacement of the pipe expanding billet by a far more easy and simple way of operation.

The invention is intended to solve the problem with the prior art by providing a member readily engageable with and disengageable from a mandrel shaft and having a pipe expanding billet fixed to the member, instead of mounting the billet directly to the mandrel shaft as is usual with the prior art.

Accordingly, the pipe expanding mandrel in accordance with the invention comprises a set pin having a pipe expanding billet in a front end portion thereof and having a reduced stepped portion formed behind the billet; a sleeve fitted on the set pin at a position behind the stepped portion and having axially oriented elongate slots formed therein, the elongate slots being engaged by a turn stopper pin extending transversely through the set pin; a spring interposed between the stepped portion of the set pin and the front end of the sleeve and which urges the stepped portion and the front end of the sleeve away from each other; an engagement protuberance formed in a rear end portion of the set pin and an engagement hole bored in a front end portion of a mandrel shaft, said engagement protuberance and engagement hole constituting means for coupling the set pin and the mandrel shaft together, free from the possibility of their becoming disengaged from each other, when the engagement protuberance is brought in engagement with the engagement hole and turned a predetermined degree; engagement lugs formed in a rear end portion of the sleeve and an engagement groove formed in a front end portion of the mandrel shaft, said engagement lugs and engagement groove constituting means for coupling the sleeve and the mandrel shaft together, free from the possibility of their turning, when the engagement lugs are brought in engagement with the engagement groove; and an extension shaft portion extending from the rear end of the engagement protuberance of the set pin and a hole bored in the mandrel shaft at the back of the engagement hole thereof, said extension shaft portion and hole constituting means for coupling the set pin and the mandrel shaft together by bringing the extension shaft portion in engagement with the hole.

With the foregoing features of the pipe expanding mandrel according to the invention, therefore, the operation of coupling the set pin having the pipe expanding billet to the mandrel shaft can be performed by bringing the engagement protuberance provided in the rear end portion of the set pin into engagement with the engagement hole provided in the front end portion of the mandrel shaft and thereafter turning them relative to each other.

In that conjunction, the sleeve is moved toward the rear end of the spring, that is, toward the front end of the mandrel shaft, to bring the engagement lugs into firm engagement with the engagement groove in the rear end portion of the sleeve, whereby any accidental turning and displacement of the sleeve can be positively prevented, which ensures accurate engagement of the engagement protuberance with the engagement hole for coupling of the set pin with the mandrel shaft.

Further, in conjunction with the coupling of the set pin to the mandrel shaft, the shaft portion extending from the rear end of the engagement protuberance of the set pin is fitted in the hole located at the back of the engagement hole of the mandrel shaft, whereby possible jolting of the set pin can be prevented.

Through the foregoing procedure of operation the pipe expanding billet can be accurately coupled and set to the mandrel shaft through the set pin.

When removing the pipe expanding billet from the mandrel shaft to which it is coupled, it is only necessary to reverse the procedure followed in the coupling operation. That is, the engagement lugs at the rear end of the sleeve are first disengaged from the engagement groove in the front end portion of the mandrel shaft, and then the sleeve and the set pin are rotated to disengage the engagement protuberance of the set pin from the engagement hole of the mandrel shaft and release the engagement of the shaft portion while the hole at the back of the engagement hole.

According to the invention, as stated above, the set pin can be coupled to the mandrel shaft, free from the possibility of their becoming disengaged from each other, by turning the set pin relative to the mandrel shaft, and the sleeve is fitted on the set pin so that the mandrel shaft is prevented from turning. Thus, when the set pin is coupled with the mandrel shaft, the set pin is positively prevented from being inadvertently turned relative to the mandrel shaft to cause their disengagement from each other.

Therefore, mounting and removal of the pipe expanding billet in relation to the mandrel shaft can be performed simply by a one-touch operation and without the use of any tool; and as compared with the conventional means for thread engagement and disengagement of the billet mounting pin, the invention is advantageous in that the required operation can be performed easily and quickly, with a great improvement being thus assured in operating efficiency.

BRIEF DESCRIPTION OF THE DRAWINGS

FIG. 3(*b*) is a schematic plan view thereof; FIG. 4(*a*) is a sectional view of a sleeve; FIG. 4(*b*) is a right side view thereof; FIG. 5(*b*) is a schematic front view showing a front end portion of a mandrel shaft; and FIG. 5(*a*) is a left side view thereof;

DETAILED DESCRIPTION OF THE INVENTION

One embodiment of the invention will now be described with reference to the accompanying drawings.

Figure 1:
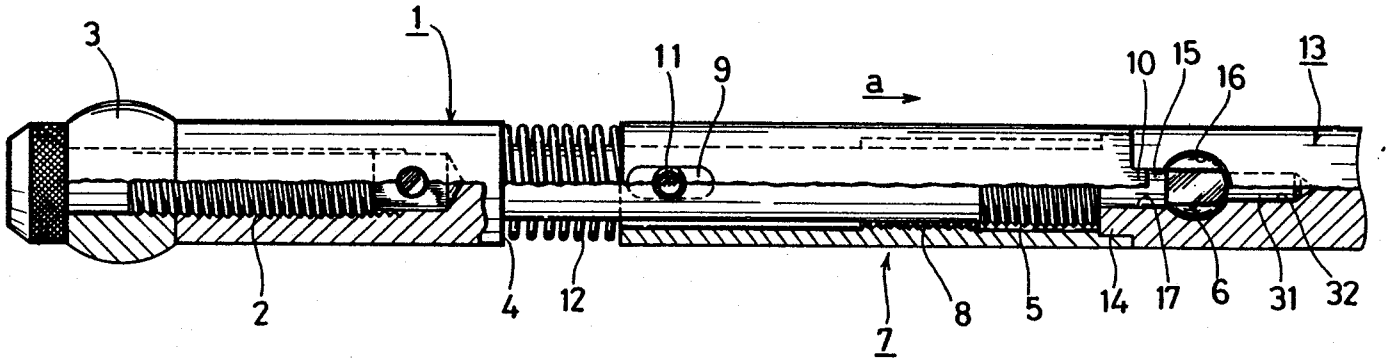
FIG. 1 is a half-cut sectional view in front elevation showing one form of mandrel embodying the invention.

In FIG. 1, numeral 1 generally designates a set pin having a hollow pipe-expanding billet 3 threadedly fixed to its front end portion through the intermediary of a threaded shaft 2, a reduced stepped portion 4 formed behind the billet 3, and a male threaded portion 5 formed behind the stepped portion 4.

Figure 3A:
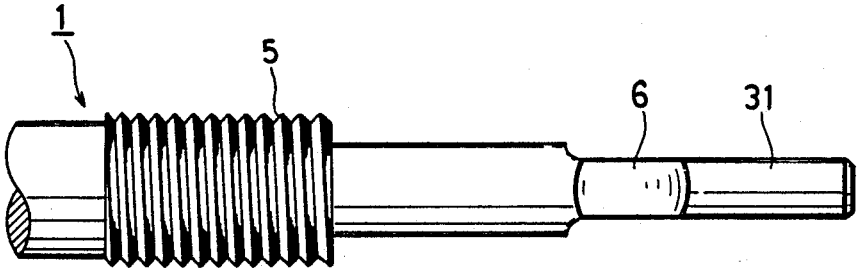
FIGS. 3 to 5 are views showing components, of which FIG. 3(*a*) is a schematic view showing the configuration of a rear end portion of a set pin.
Figure 3B:
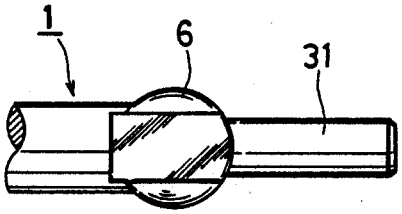

Referring to FIGS. 3*a* and 3*b*, a flat engagement protuberance 6 having a flat circular shape extends from a rear end portion of the set pin 1, and an extension shaft portion 31 extends from the rear end of the engagement protuberance 6.

Figure 4A:
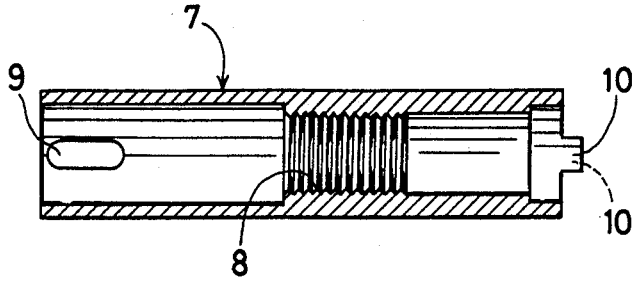
Figure 4B:
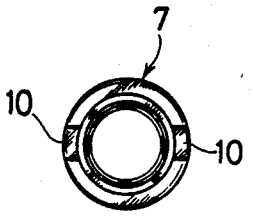
Figure 5A:
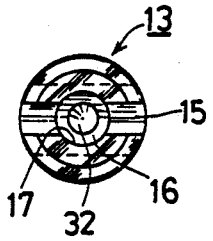
Figure 5B:
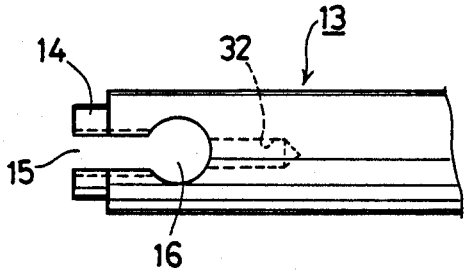
Figure 6:
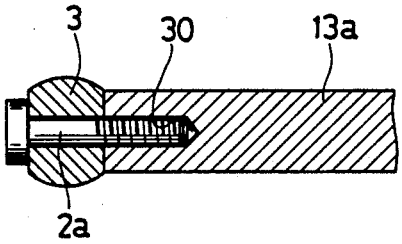
FIG. 6 is a sectional view showing principal portions of a conventional arrangement.

Numeral 7 designates a generally cylindrical sleeve which, as FIG. 4*a* shows, has an internally threaded portion 8 formed on the inner periphery thereof, two axially oriented elongate slots 9, 9. and tongue-like engagement lugs 10, 10 formed at the rear end. The externally threaded portion 5 of the set pin 1 threadedly extends through the internally threaded portion 8 formed on the inner periphery of the sleeve 7 so that the sleeve 7 is slidably fitted on a shaft portion behind the stepped portion of the set pin 1.

A turn stopper pin 11 is disposed at a predetermined position between the stepped portion 4 and the externally threaded portion 5 of the set pin 1 and extends transversely through the set pin 1, the turn stopper pin 11 being in engagement at both ends thereof with the elongate slots 9, 9 of the sleeve 7 so as to prevent rotation between the set pin 1 and the sleeve 7.

Between the stepped portion 4 of the set pin 1 and the front end portion of the sleeve 7 there is interposed a spring 12 which acts to resiliently widen the space between the two portions by urging the sleeve 7 backward, that is, in the direction of the arrow a.

Numeral 13 designates an elongate column-shaped mandrel shaft having a small-diameter stepped portion 14 at the front end thereof, an engagement groove 15 of a predetermined width at the front end thereof, an engagement hole 16 formed behind the engagement groove 15 in continuation therefrom, the engagement hole 16 being dimensionally larger than the width of the engagement groove 15 and being spherically shaped or circular shaped as viewed in side elevation, and a hole portion 32 extending rearward from the engagement hole 16.

Numeral 17 designates a hole bored in the front end portion of the mandrel shaft 13 in superposed relation with the engagement groove 15, the hole 17 being deep enough to reach the engagement hole 16.

Structural features of the present embodiment have been described above. Next, the manner of operation and function of the embodiment will be explained.

Figure 2:
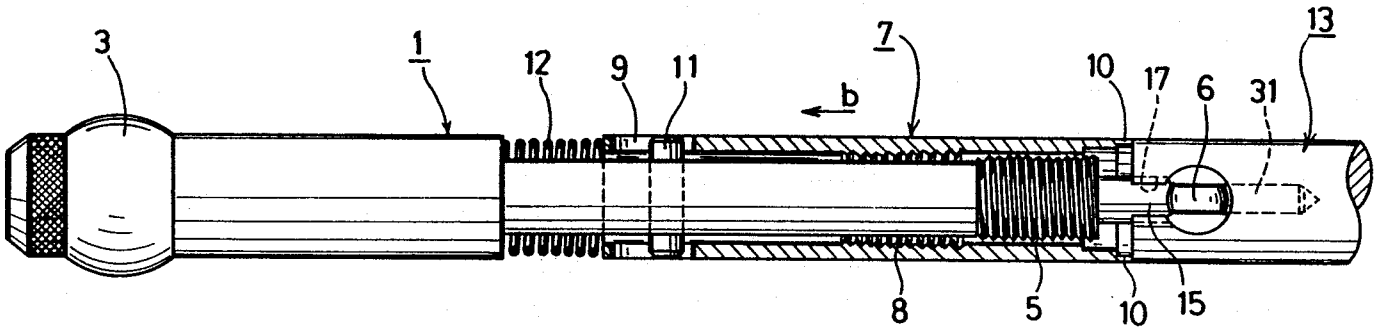
FIG. 2 is a sectional view showing a pipe expanding billet as it appears in the process of mounting and removing operation.

As shown in FIG. 2, the sleeve 7 is fitted on the set pin 1. With the mandrel positioned as shown, the sleeve 7 is drawn in the direction of the arrow b against the biasing force of the spring 12 to allow the rear end of the set pin 1 to project from the sleeve 7, as FIG. 2 shows, so that the engagement protuberance 6 at the rear end of the set pin 1 is inserted into the engagement hole 16 of the mandrel shaft 13 through the engagement groove 15 and hole 17. Simultaneously, the shaft portion 31 extending from the rear end of the engagement protuberance 6 is fitted into the hole portion 32 behind the engagement hole 16 of the mandrel shaft 13.

Subsequently, the sleeve 7 and the set pin 1 are turned 90 degrees so that the engagement protuberance 6 is turned while in agreement with the configuration of the engagement hole 16. Therefore, through the engagement of the engagement protuberance 6 of the set pin 1 with the engagement hole 16, the set pin 1 is coupled to the mandrel shaft 13, free from slip-off possibility. Since the shaft portion 31 is fitted into the hole portion 32, the set pin 1 is prevented from any separation by jolting.

In that condition, however, a further turn of the set pin 1 relative to the mandrel shaft 13 may easily release the engagement between the engagement protuberance 6 and the engagement hole 16.

Then, the sleeve 7 is moved in the direction of the arrow a under the biasing force of the spring 12 until it is fitted on the small-diameter stepped portion 14. In that position, as FIG. 1 shows, the engagement lugs 10, 10 at the rear end of the sleeve 7 is fitted into the engagement groove 15 of the mandrel shaft 13. Thus, because of the engagement between the engagement groove 15 and the engagement lugs 10, 10, the sleeve 7 and the set pin 1 are positively prevented from rotating relative to the mandrel 13.

Consequently, the engagement protuberance 6 of the set pin 1 is kept in satisfactory engagement with the enggement hole 16, free from the possibility of its engagement with the engagement hole 16 being inadvertently released to cause undesired disengagement of both the set pin 1 and the sleeve 7 from the mandrel shaft 13.

Further, the fitting of the sleeve 7 over the small-diameter stepped portion 14 of the mandrel shaft 13 provides satisfactory axial alignment of the sleeve 7 and the mandrel shaft 13.

Thus, the mandrel fitted firmly with the pipe expanding billet 3 as above described can be advantageously employed in pipe expanding operations without any trouble whatsoever.

When replacing the billet-mounted set pin, the set pin 1 and sleeve 7 coupled to the mandrel shaft 13 are disengaged from the mandrel 13. The necessary procedure for this operation is just the reverse to that for the above described coupling operation.

That is, the sleeve 7 is first advanced in the direction of the arrow b to release the engagement between the engagement lugs 10, 10 of the sleeve 7 and the engagement groove 15 of the mandrel shaft 13. Then, the sleeve 7 and the set pin 1 are turned 90 degrees to release the engagement between the engagement protuberance 6 of the set pin 1 and the engagement hole 16 of the mandrel shaft 13, as well as the engagement between the shaft portion 31 and the hole portion 32. This operation is very simple and can be performed easily and quickly without the use of any tool.

According to the arrangement of the present embodiment, when both the sleeve 7 and the set pin 1 have been disengaged from the mandrel shaft 13 the internal thread portion 8 and external thread portion 5 formed respectively on the sleeve 7 and on the set pin 1 prevent the slipping off of the sleeve 7 from the rear side of the set pin 1 which would otherwise occur under the biasing force of the spring 12, because the thread portions 8, 5 abut against each other to lock the one to the other. Such non-disengageability provides ease of handling with respect to components.

In the above described embodiment, the pipe expanding billet 3 is constructed separately from the set pin 1. It is to be understood, however, that in the invention the mounting construction of the pipe expanding billet 3 relative to the set pin 1 is not limited. For example, the pipe expanding billet 3 and the set pin 1 may be integrally constructed to form onesingle unit.

In the above embodiment, the engement protuberance 6 at the rear end of the set pin 1 is of a flat circular shape and the engagement hole 16 of the mandrel shaft 13 is so configured as to match the shape of the engagement protuberance 6. In the invention, however, the configurations of the engagement protuberance 6 and engagement hole 16 are not limited to those shown. Of course it is possible that an engagement protuberance 6 is provided in a front end portion of the mandrel shaft 13 while an engagement hole 16 is provided in a rear end portion of the set pin 1.

In essence, it is necessary that the set pin 1 and the mandrel shaft 13 be individually provided in their respective rear end and front end portions with one or the other of such engagement protuberance 6 and engagement hole 16 as are engageable with each other to permit them to be non-disengageably coupled together through their turning a predetermined angle.

In the above described embodiment, the tongue-like lugs 10, 10 provided at the rear end of the sleeve 7 are engageable with the engagement groove 15 provided in continuation to the engagement hole 16 of the mandrel shaft 13. It is understood, however, that in the invention the construction of the engagement lugs 10, 10 and engagement groove 15 are not limited to that shown. It is possible that separately from the engagement hole 16, an engagement groove 15 may be provided in a front end portion of the mandrel shaft 13. Of course, it is also possible that engagement lugs 10 may be provided in the mandrel shaft 13 on one hand, while on the other hand an engagement groove 15 may be provided on the sleeve side.

What is important is that in a rear end portion of the sleeve 7 and in a front end portion of the mandrel shaft 13 there be individually provided engagement lugs 10 and an engagement groove 15 which are engageable together to permit the sleeve 7 and the mandrel shift 13 to be coupled to each other so as to prevent them from turning. The number of engagement lugs, etc. is not particularly limited.

In the invention, the arrangement of the set pin 1, sleeve 7, and other components is not limited to that shown in the foregoing embodiment. For example, the provision of the external and internal thread portions 5, 8 as anti-slip off means is not an essential requirement.

In addition, it is understood that the arrangement of individual parts constituting the pipe expanding mandrel of the invention may be changed, modified, or varied in design within the spirit and concept of the invention.

What is claimed is:

1. A pipe expanding mandrel comprising:

a set pin having a pipe expanding billet located on a front end portion thereof and having a reduced stepped portion formed behind the billet;

a sleeve fitted on the set pin at a position behind the reduced stepped portion and having axially oriented elongate slots formed therein, the elongate slots being engaged by a turn stopper pin extending transversely through the set pin;

a spring interposed between the reduced stepped portion of the set pin and the front end of the sleeve and which urges the reduced stepped portion and the front end of the sleeve away from each other;

means, including an engagement protuberance and an engagement hole, for coupling the set pin and a mandrel shaft together, said engagement protuberance being located on one of said set pin or mandrel shaft and the engagement hole being located on the other, free from the possibility of their becoming disengaged from each other, when the engagement protuberance is brought in engagement with the engagement hole and turned a predetermined degree;

means, including engagement lugs and an engagement groove, for coupling the sleeve and the mandrel shaft together, said engagement lugs being located on one of said sleeve or mandrel shaft and the engagement groove being located on the other, free from the possibility of their turning, when the engagement lugs are brought in engagement with the engagement groove; and an extension shaft portion extending from the rear end of the engagement protuberance and a hole bored at the back of the engagement hole thereof, said extension shaft portion and hole constituting means for further coupling the set pin and the mandrel shaft together by bringing the extension shaft portion in engagement with the hole.

2. A pipe expanding mandrel as set forth in claim 1, further comprising an external thread portion and an internal thread portion provided respectively at a location behind the reduced stepped portion of the set pin and on an inner periphery of the sleeve.

3. A pipe expanding mandrel as set forth in claim 1, wherein said pipe expanding billet is mounted to said set pin at the front end portion by a threaded shaft.

4. A pipe expanding mandrel as set forth in claim 1 wherein the engagement protuberance is provided at a rear end of the set pin and is of a flat circular shape and the engagement hole is provided in a front end of the mandrel shaft and is of a spherical shape.

5. A pipe expanding mandrel as set forth in claim 1 wherein said engagement hole is provided in a rear end portion of the set pin and said engagement protuberance is provided at a front end portion of the mandrel shaft.

6. A pipe expanding mandrel as set forth in claim 1 wherein said engagement groove is provided in a rear end portion of the sleeve and said engagement lugs are provided in a front end portion of the mandrel shaft.

7. A pipe expanding mandrel as set forth in claim 1 wherein said engagement hole is provided in a front end portion of the mandrel shaft and said engagement protuberance is formed in a rear end portion of the set pin.

8. A pipe expanding mandrel as set forth in claim 1 wherein said engagement groove is provided in a front end portion of the mandrel shaft and said engagement lugs are provided in a rear end portion of the sleeve.

* * * * *